US007784145B1

(12) United States Patent
Prokop

(10) Patent No.: US 7,784,145 B1
(45) Date of Patent: Aug. 31, 2010

(54) ROLLER SURFACE INSERT

(75) Inventor: Gary F. Prokop, Wheaton, IL (US)

(73) Assignee: Valspar Sourcing, Inc., Minneapolis, MN (US)

( * ) Notice: Subject to any disclaimer, the term of this patent is extended or adjusted under 35 U.S.C. 154(b) by 1226 days.

(21) Appl. No.: 11/360,163

(22) Filed: Feb. 23, 2006

Related U.S. Application Data

(60) Provisional application No. 60/657,266, filed on Mar. 1, 2005.

(51) Int. Cl.
*B05C 21/00* (2006.01)
*B44D 3/12* (2006.01)

(52) U.S. Cl. ..... 15/257.06; 220/570; 220/695; 220/702; D32/53.1

(58) Field of Classification Search ..... 15/257.05, 15/257.06; 220/570; D32/53.1
See application file for complete search history.

(56) References Cited

U.S. PATENT DOCUMENTS

| | | | | |
|---|---|---|---|---|
| 2,659,096 | A | 11/1953 | Mencfeldowski, Jr. | |
| 2,659,917 | A | 11/1953 | Drum | |
| 2,698,450 | A | 1/1955 | Mack | |
| 2,705,334 | A | 4/1955 | Farrow | |
| 2,777,142 | A | 1/1957 | LoVerde | |
| 2,827,648 | A | 3/1958 | Geisz | |
| 2,893,030 | A * | 7/1959 | Averna | 15/257.06 |
| 2,932,838 | A * | 4/1960 | Ouellette | 15/257.06 |
| 3,394,425 | A * | 7/1968 | Welt | 15/257.06 |
| 3,732,593 | A | 5/1973 | Habostad | |
| 3,761,995 | A | 10/1973 | Rinard | |
| 3,825,970 | A | 7/1974 | Hanssen | |
| 3,828,389 | A | 8/1974 | Heisler | |
| 3,837,035 | A | 9/1974 | Habostad | |
| D246,439 | S | 11/1977 | Lynn et al. | |
| 4,107,815 | A | 8/1978 | Dumesnil, Jr. | |
| 4,145,789 | A * | 3/1979 | Morgan, Sr. | 15/257.06 |
| 4,200,949 | A | 5/1980 | Heniff, Jr. | |
| 4,756,046 | A * | 7/1988 | Surface et al. | 15/257.06 |
| 4,865,282 | A * | 9/1989 | Yonkman et al. | 248/111 |

(Continued)

FOREIGN PATENT DOCUMENTS

DE 4314465 A1 11/1994

(Continued)

OTHER PUBLICATIONS

U.S. Appl. No. 29/197,434, filed Jan. 15, 2004, Prokop et al.

(Continued)

*Primary Examiner*—Mark Spisich
(74) *Attorney, Agent, or Firm*—Mueting Raasch & Gebhardt, P.A.

(57) ABSTRACT

A removable roller surface insert for use with a container of rollable liquid. The insert may, in one embodiment, include a roller surface having an upper edge, and an upper contact portion attached to the roller surface at or near the upper edge. The upper contact portion may be configured to contact an inner sidewall surface of the container at or near the upper rim. All, or substantially all, of the insert may be, when the insert is in a use position, located within a first half of the container, the first half defined by a vertical plane passing through a centerline of the container.

5 Claims, 10 Drawing Sheets

U.S. PATENT DOCUMENTS

| | | | | |
|---|---|---|---|---|
| 4,893,723 | A | 1/1990 | Seabolt | |
| 4,928,843 | A | 5/1990 | Gunderson | |
| 5,085,317 | A | 2/1992 | Jensen et al. | |
| 5,314,061 | A | 5/1994 | Bedrossian | |
| 5,341,969 | A | 8/1994 | Accardo et al. | |
| 5,400,916 | A | 3/1995 | Weber | |
| 5,404,611 | A | 4/1995 | Raney | |
| 5,472,111 | A | 12/1995 | Renfrew | |
| 5,489,051 | A | 2/1996 | Robinson | |
| 5,533,228 | A | 7/1996 | Jarecki et al. | |
| 5,727,708 | A | 3/1998 | Erickson | |
| 5,810,196 | A | 9/1998 | Lundy | |
| 5,893,489 | A | 4/1999 | Giarrante | |
| 5,975,346 | A | 11/1999 | Imperato et al. | |
| 5,992,106 | A | 11/1999 | Carling et al. | |
| 6,019,241 | A | 2/2000 | Burns | |
| 6,102,235 | A | 8/2000 | Stern et al. | |
| 6,119,303 | A * | 9/2000 | Passafiume | 15/257.06 |
| 6,199,718 | B1 | 3/2001 | Ellis | |
| 6,269,967 | B1 | 8/2001 | de Vries | |
| 6,412,661 | B1 | 7/2002 | Hannah, Sr. | |
| D518,265 | S | 3/2006 | Prokop et al. | |
| 7,036,182 | B2 * | 5/2006 | Bukovitz et al. | 15/257.06 |
| D524,003 | S | 6/2006 | Prokop et al. | |
| D524,501 | S | 7/2006 | Prokop et al. | |
| 7,137,168 | B2 * | 11/2006 | Mann | 15/257.06 |
| 2001/0050284 | A1 | 12/2001 | Jaeger | |
| 2003/0074760 | A1 | 4/2003 | Keller | |
| 2004/0226958 | A1 | 11/2004 | Robellard et al. | |
| 2006/0226156 | A1 * | 10/2006 | Lundy et al. | 220/570 |

FOREIGN PATENT DOCUMENTS

| | | | |
|---|---|---|---|
| EP | 1293360 | A1 | 3/2003 |
| FR | 2087688 | | 12/1971 |
| WO | 94/23958 | * | 10/1994 |
| WO | 2003091123 | A1 | 11/2003 |

OTHER PUBLICATIONS

U.S. Appl. No. 29/197,448, filed Jan. 15, 2004, Prokop et al.

"Ropak Packaging Home Page" [online]. Ropak Packaging, Fullerton, CA, 2002 [retrived on Jul. 13, 2004]. Retrieved from the Internet: <URL: www.ropakcorp.com/lpg/lpacpub01.nsf/Content/RPK__Ropak__Homepage>; 1 pg.

"Square Containers" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__product__type2>; 1 pg.

"2.1-Gallon Square Container (S026)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__square__S026>; 1 pg.

"2.1-Gallon Square Container (SA26)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__square__SA26>; 1 pg.

"EZ Stor Containers" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__product__type3>; 1 pg.

"1-Gallon EZ Stor Container (E015)" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E015>; 1 pg.

"2-Gallon EZ Stor Container" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E027>; 1 pg.

"3-Gallon EZ Stor Container" datasheet [online]. Ropak Packaging, Fullerton, CA, 2002 [retrived on Jul. 13, 2004]. Retrieved from the Internet: <URL: www.ropakcorp.com/lpg/lpacpub01.nsf/Content/rpk__EZStor__E037>; 1 pg.

Exhibit A, pictures of Cuprinol "Rollable Shed & Fence Treatment" Container, and UK Patent Office Status Information, Cuprinol, Berkshire, UK; container believed to be available in UK in Feb. 2002; 12 pages.

Exhibit B, Dutch Boy "Ready to Roll" informational document. Dutch Boy Group, Cleveland, OH, document available at least as early as Aug. 26, 2004; 2 pages.

* cited by examiner

ROLLER SURFACE INSERT

RELATED APPLICATION(S)

This application claims the benefit of U.S. Prov. App. No. 60/657,266, filed 1 Mar. 2005, which is hereby incorporated by reference herein in its entirety.

TECHNICAL FIELD

The present invention relates generally to liquid containers and, more particularly, to roller surface inserts for use with liquid containers, and methods of using the same.

BACKGROUND

The use of nap rollers (also referred to herein as rollers and roller applicators) for applying rollable liquids like paint to large areas such as walls or ceilings is well known in both commercial and consumer ("do it yourself" or "DIY") markets. Generally speaking, these rollers are used in conjunction with a paint roller tray. Paint roller trays are generally rectangular in shape and include a tray floor configured as an inclined roller surface. The inclined surface typically terminates at a paint well at one end of the tray. During use, the paint roller tray is filled with paint from a paint container. A roller may be dipped into the paint well and rolled back and forth across the inclined roller surface. This rolling action not only removes excess paint from a surface of the roller, but may also distribute paint more evenly on the roller. The roller may then be rolled across a paintable surface, whereby paint is transferred thereto.

While rollers are used heavily by commercial painters, the use of paint roller trays is perceived, at least in some segments of the DIY market, to have potential drawbacks. For example, paint roller trays generally require pouring paint from an original paint container into the paint roller tray prior to use. Yet, pouring paint from the original paint container to the tray may result in accidental paint spillage and/or splashing. Moreover, many paint cans and buckets may not be optimally shaped for pouring. As a result, the step of pouring paint often results in a certain quantity of paint dripping down the side of the container. At the completion of a painting project, the excess paint in the tray is generally discarded or returned to the original paint container. Again, this transfer of paint may result in unintended spillage.

SUMMARY

The present invention provides roller surface inserts and containers incorporating the same that address these and other problems. For example, in one embodiment, a removable roller surface insert for use within a generally cylindrical, open-top container having an upper rim is provided. The container includes a first half and a second half defined by a vertical plane passing through a centerline of the container. The insert includes a roller surface having an upper edge, and an upper contact portion attached to the roller surface at or near the upper edge. The upper contact portion is configured to contact at least one of: the upper rim; and an inner sidewall surface of the container at or near the upper rim. All, or substantially all, of the insert is, when in a use position, located within the first half of the container.

In another embodiment of the present invention, a removable roller surface insert for use within a generally cylindrical, open-top container having an upper rim is provided. The container includes a first half and a second half defined by a vertical plane passing through a centerline of the container. The insert includes a substantially planar roller surface operable to distribute a rollable liquid residing within the container over a roller applicator. The insert further includes an upper contact portion attached to an upper edge of the roller surface, the upper contact portion being bound by a plane containing the roller surface. Furthermore, the upper contact portion is configured to span between the upper edge of the roller surface and an inner sidewall surface of the container at a location at or near the upper rim. All, or substantially all, of both the roller surface and the upper contact portion are, when the insert is in a use position, located within the first half of the container.

In yet another embodiment, a roller surface insert is provided for use with a container including a rollable liquid. The insert includes: a contact portion for frictionally engaging an inner sidewall surface of the container; and a roller surface attached to the contact portion and suspended within the container. The roller surface is operable to distribute the rollable liquid over a roller applicator.

The above summary is not intended to describe each embodiment or every implementation of the present invention. Rather, a more complete understanding of the invention will become apparent and appreciated by reference to the following Detailed Description of Exemplary Embodiments in view of the accompanying figures of the drawing.

BRIEF DESCRIPTION OF THE VIEWS OF THE DRAWING

The present invention will be further described with reference to the figures of the drawing, wherein:

FIGS. 1A, 1B, and 1C illustrate a roller surface insert and container in accordance with one embodiment of the invention, wherein: FIG. 1A is a perspective view of the insert and container; FIG. 1B is a top plan view thereof; and FIG. 1C is a section view taken along line 1C-1C of FIG. 1B;

FIGS. 2A, 2B, and 2C illustrate a roller surface insert and container in accordance with another embodiment of the invention, wherein: FIG. 2A is a perspective view of the insert and container; FIG. 2B is a top plan view thereof; and FIG. 2C is a section view taken along line 2C-2C of FIG. 2B;

FIGS. 3A, 3B, and 3C illustrate a roller surface insert and container in accordance with yet another embodiment of the invention, wherein: FIG. 3A is a perspective view of the insert and container; FIG. 3B is a top plan view thereof; and FIG. 3C is a section view taken along line 3C-3C of FIG. 3B;

FIGS. 4A, 4B, 4C, and 4D illustrate a roller surface insert and container in accordance with yet another embodiment of the invention, wherein: FIG. 4A is a perspective view of the insert and container; FIG. 4B is a top plan view thereof; FIG. 4C is a section view taken along a line 4C-4C of FIG. 4B; and FIG. 4D is an exploded perspective view of the insert removed from the container;

FIGS. 5A, 5B, and 5C illustrate a roller surface insert and container in accordance with still yet another embodiment of the invention, wherein: FIG. 5A is a perspective view of the insert and container; FIG. 5B is a top plan view thereof; and FIG. 5C is section view taken along line 5C-5C of FIG. 5B; and FIGS. 6A-6C illustrate a roller surface insert and container in accordance with another embodiment of the invention, wherein: FIG. 6A is a perspective view of the insert and container; FIG. 6B is a section view taken along a horizontal plane passing through a vertical centerline of the container and insert of FIG. 6A; and FIG. 6C is an enlarged view of a portion of the insert.

Figure 1A:
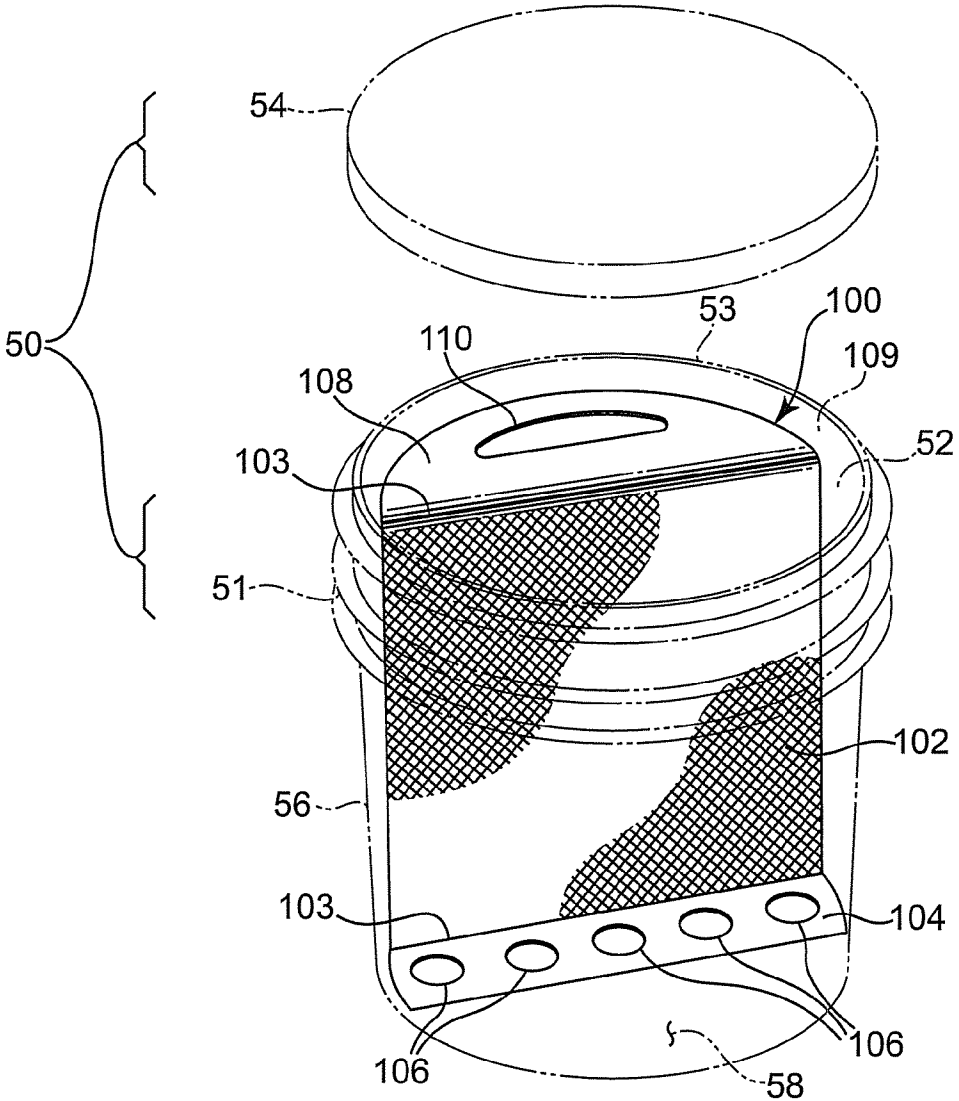

The figures of the drawing are generally diagrammatic and, therefore, may not necessarily be rendered to scale.

DETAILED DESCRIPTION OF EXEMPLARY EMBODIMENTS

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

U.S. patent application Ser. No. 10/758,626, filed Jan. 15, 2004, is incorporated by reference herein in its entirety.

Generally speaking, the present invention is directed to a resealable container assembly having a lid or lid portion that is at least partially separable from a container or body portion. The container may form an open top reservoir operable to hold up to a designated volume of liquid, e.g., a rollable liquid such as paint. When the lid is removed or otherwise separated from the container, the interior reservoir is accessible through the open top.

The present invention may further provide a removable roller surface insert incorporating one or more roller surfaces. The insert may fit within, or otherwise attach to, the container as further described below. In some embodiments, the insert may be positioned differently for storage than it is for use.

It is noted that the terms "comprises" and variations thereof do not have a limiting meaning where these terms appear in the accompanying description and claims. Moreover, "a," "an," "the," "at least one," and "one or more" are used interchangeably herein.

The containers and methods of the present invention are described herein in the context of paint. However, this usage is illustrative only. In fact, those of skill in the art will realize that containers and methods of the present invention may be utilized with most any liquid, e.g., paints, stains, floor coatings, adhesives, sealants, mastics, etc., without departing from the scope of the invention.

The roller surface may be configured to assist a user in removing excess liquid (e.g., paint) from a roller-type liquid applicator, e.g., a paint roller applicator, and further assist in distributing liquid over the applicator surface. For example, the roller surface may include a perforated surface (such as a screen or grate) and/or a surface having protrusions or other surface variations. As a result, movement of the applicator over the roller surface may distribute liquid over the applicator surface while also removing excess liquid therefrom. Preferably, the effective length of the roller surface is equal to or greater than a circumference of the applicator. In another embodiment, the roller surface may be configured as one or more squeegee-type elements or surfaces that assist in distributing liquid over (and removing excess liquid from) the applicator surface. By permitting liquid application and distribution with the roller surface insert, inserts in accordance with embodiments of the present invention may eliminate the need for separate equipment, e.g., may eliminate the need for a separate roller tray.

In some embodiments, the roller surface insert, e.g., the roller surface, may be removably coupled with the container. The term "removably coupled" is intended to include most any configuration that allows at least temporary coupling or fixing of the roller surface to the container. For instance, the roller surface insert may frictionally engage the container (contact the container with an interference fit). Alternatively, the insert may hang or suspend from a portion (e.g., an upper lip or edge) of the container, or rest or wedge in the container, e.g., on the container floor.

The inserts are illustrated and described herein in conjunction with containers that are generally cylindrical in shape. However, other shapes are certainly possible without departing from the scope of the invention. Moreover, while container capacities of about one to about ten gallons, more preferably about two to about five gallons, are contemplated, inserts may be made to function with containers of most any size and shape without departing from the scope of the present invention.

Figure 1C:
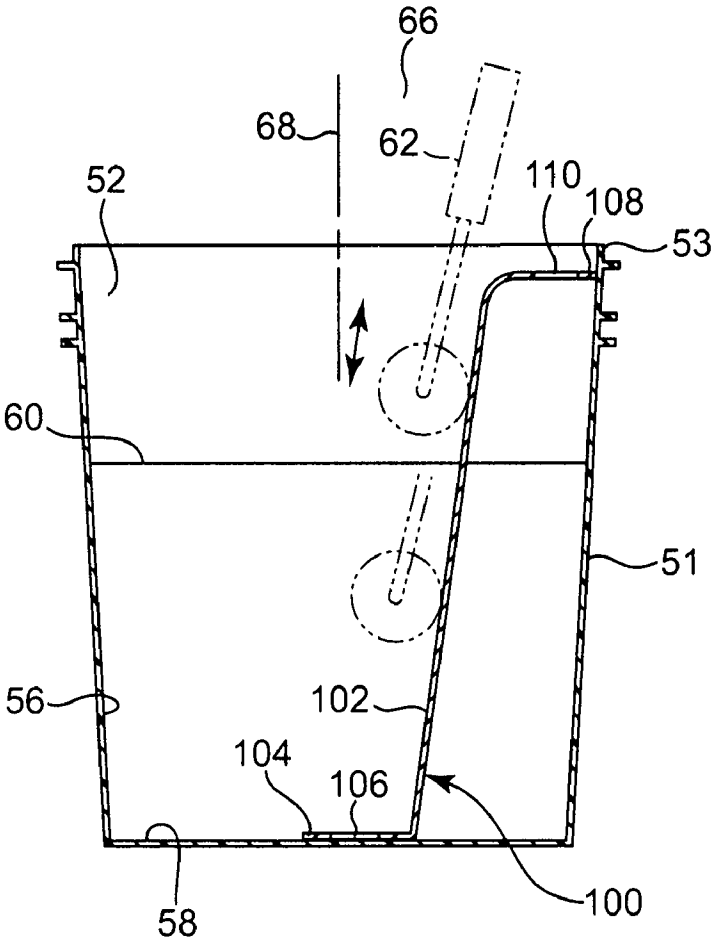
Figure 1B:
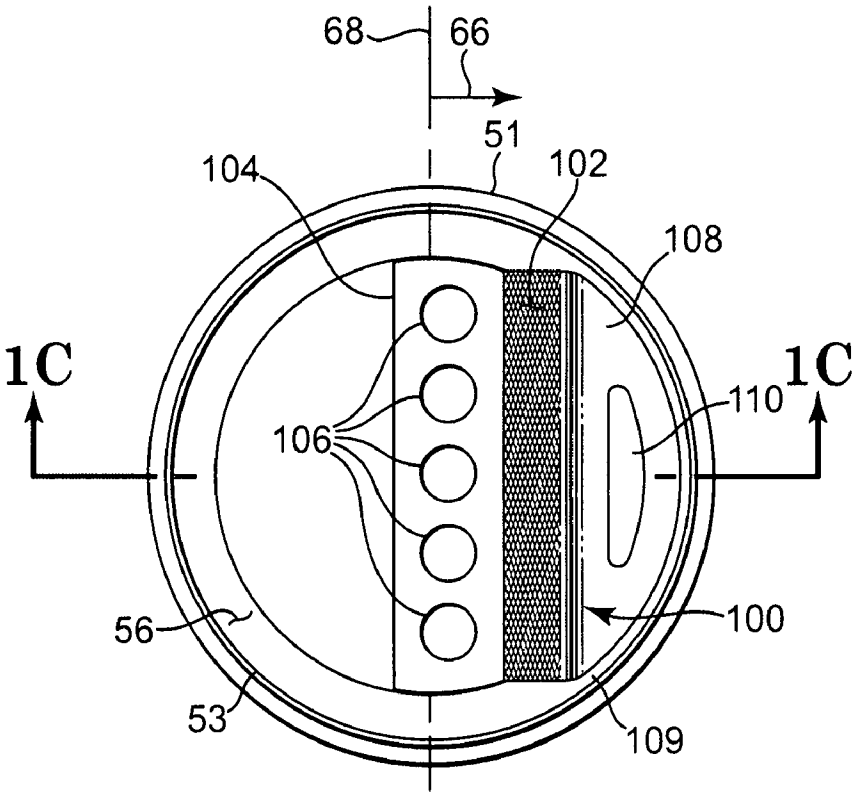

With this general introduction, attention is now directed to the figures. FIGS. 1A-1C illustrate an exemplary liquid container assembly, e.g., paint container assembly 50, and a roller surface insert 100 in accordance with one embodiment of the invention. The exemplary container assembly 50 may include a generally cylindrical, open-top container, 51, e.g., a five-gallon bucket, and a removable and reusable lid 54 operable to seal with an upper rim 53 of the container. The container may further include an open top 52 that provides access to a stored volume of liquid, e.g., paint 60 (see FIG. 1C), when the lid 54 is removed. The volume of the container 50, in the illustrated embodiment, is bounded by an inner sidewall surface 56 and a floor 58.

The phrase "generally cylindrical" includes both cylindrically-shaped containers (e.g., those having vertical sidewalls), as well as more conventional bucket containers (such as those illustrated herein) that have a circular opening and a tapered sidewall extending to a circular base that is smaller than the opening.

The insert 100 may include a roller surface 102 that, in one embodiment, is substantially planar. When the insert is positioned in the container 51 in a use position, the roller surface 102 may extend upwardly at an angle of about 45 degrees or less from vertical, preferably about 20 degrees or less, and more preferably about 15 degrees or less (see FIG. 1C). In some embodiments, the roller surface 102 may be substantially vertical. The angle may generally be selected to ensure that the width of the roller surface 102 near the upper rim 53 is wide enough to accommodate a standard paint roller.

The insert 100 may also include an optional lower contact portion, e.g., foot 104, attached to a lower edge of the roller surface 102 and operable to seat against the floor 58 and/or sidewall surface 56 of the container 50 as illustrated in the figures. The outer edges of the foot 104 may have a peripheral shape (e.g., arc) that generally conforms to a shape of a corresponding portion of the floor 58 and adjoining sidewall surface 56, e.g., the foot may fit snugly across the widest portion of the floor as shown in FIG. 1B. Alternatively, the container 50 could incorporate features, e.g., tabs, which permit the foot 104 to snap in place relative to the container. The foot 104 may attach to the surface 102 with a flexible or pivotable connection, e.g., a living hinge 103 (see FIG. 1A).

The foot 104 may include one or more openings 106. The openings 106 permit paint 60 to flow through the foot 104 during placement of the insert 100 into the container 51, and further permit draining of paint when the insert is removed.

The insert 100 may further include a second or upper container contact portion, e.g., cap 108, attached at or near an upper edge of the roller surface 102 as shown in FIG. 1A. The cap 108, as with the foot 104, may be configured to have a contact surface or peripheral shape (e.g., semicircular) that generally conforms to a shape of a corresponding portion of the container 51 when the insert is in the desired location (note: a gap 109 may exist near the outer edges of the cap when a generally rectangular roller surface 102 is used with a tapered container 51 as shown). For example, the cap 108 may be configured to contact or rest against the inner sidewall surface 56 at or near the upper rim 53.

In the illustrated embodiment (see, e.g., FIGS. 1A and 1B), the cap 108 is bound by a plane that contains the roller surface 102. The cap 108 may span between the upper edge of the roller surface 102 and the inner sidewall surface 56 of the container at or near the upper rim 53 as shown in FIG. 1C.

The cap 108 may also include a slot 110 or other opening to allow for grasping of the insert 100 with a hand or tool. The roller surface 102, the foot 104, and the cap 108 may be formed (e.g., molded) as a single component. The cap 108, like the foot 104, could hinge to the roller surface 102 (e.g., include a hinge 103 as identified in FIG. 1A) so that the insert could ship in a flat configuration. In case of the latter, the cap 108 and/or the roller surface 102 may include engagement members (e.g., tabs) that lock the cap in place, relative to the roller surface, before use.

The insert 100 may be configured such that, when positioned in the container 51 in its use position as illustrated, the insert, e.g., the cap 108, may be below an uppermost portion (the upper rim 53) of the container 51. As a result, the insert 100 may remain in the container when the lid 54 is secured.

Moreover, the cap 108 may be configured to support the insert 100 relative to an upper surface of a first half or side 66 of the container 51. In the illustrated embodiments, the first half 66 may be defined by a vertical plane 68 passing through a centerline, e.g., a longitudinal centerline, of the container as shown in FIGS. 1B and 1C. The foot 104 and the roller surface 102 may also be configured such that all, or substantially all, of the insert (e.g., the roller surface 102 and cap 108) is, when in the use position, located on a first side of the plane 68, e.g., located within the first half 66. As a result, a roller applicator 62 (see FIG. 1C) may be positioned near the widest part of the container 51 when it is near the floor 58.

The roller surface 102 may be of most any configuration that permits distribution of paint over the roller applicator and allows excess paint removed from the applicator to flow back into the container 51. For example, the roller surface 102 could be configured as a perforated screen or grid defined by numerous intersecting elements (e.g., wires) separated by through-holes. Such a configuration may permit adequate paint distribution over the applicator surface while also allowing excess paint to run down the surface 102 or drip through the perforations. However, this configuration is not limiting as other perforated and non-perforated roller surface configurations/materials are also contemplated. For instance, a surface having a series of protrusions, e.g., chevrons (not shown), may be provided. Preferably, the protrusions would not interfere with the flow of liquid from the roller surface 102 back into the container 50.

Ideally, the roller surface 102 and the remaining portions of the insert 100 are produced from a non-rusting material, e.g., plastic or a metal such as aluminum. As a result, contamination to the paint 60 from deterioration/corrosion of the insert 100/surface 102 is minimized.

In use, the insert 100 (which may be provided with the container or purchased separately) may be placed into the container 51 after removal of the lid 54. Once seated as shown in the figures, the applicator 62 may be dipped into the paint 60, withdrawn, and rolled back and forth over a portion of the roller surface 102 that is not submerged (see FIG. 1C). Initially, the exposed portion of the roller surface 102 may be small. However, as the paint level is reduced, the exposed surface increases, providing a larger rolling area. When the volume of paint remaining in the container is small, the container 51 may be tipped to force the remaining paint to a location on the floor 58 that is most easily accessible by the applicator 62. If any paint is remaining in the container 51 at the completion of the painting project, the lid 54 may be sealed to the container 51 without removal or repositioning of the insert 100.

Figure 2A:
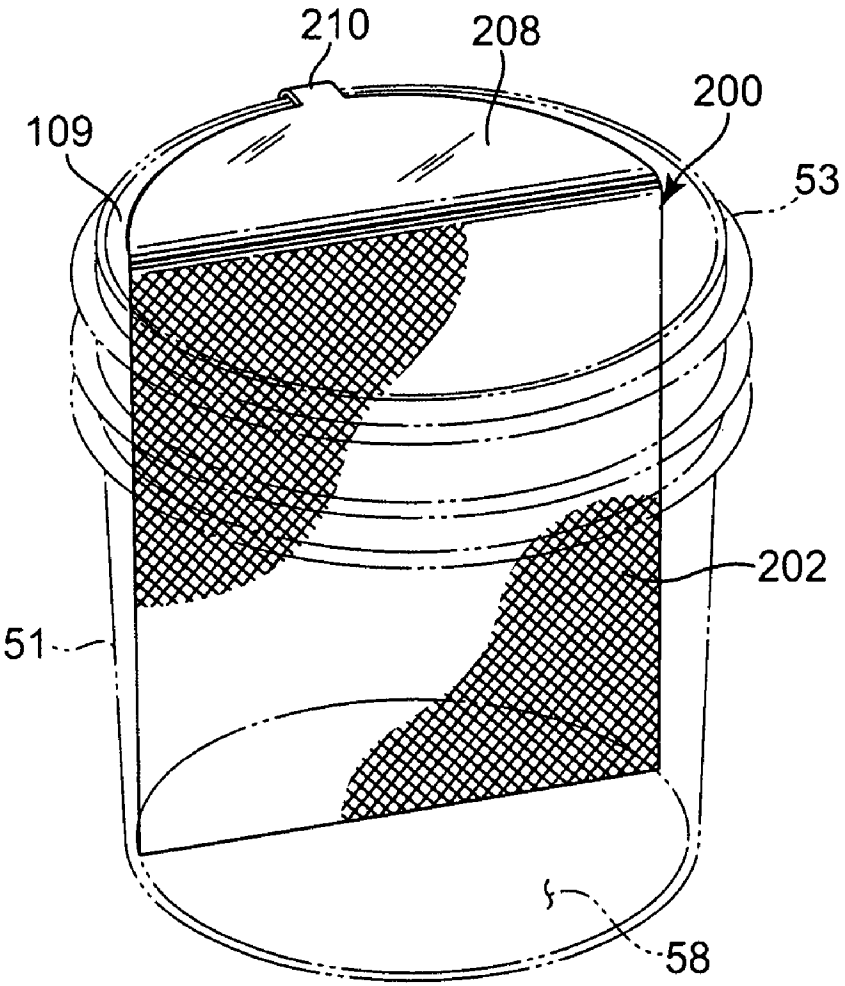
Figure 2C:
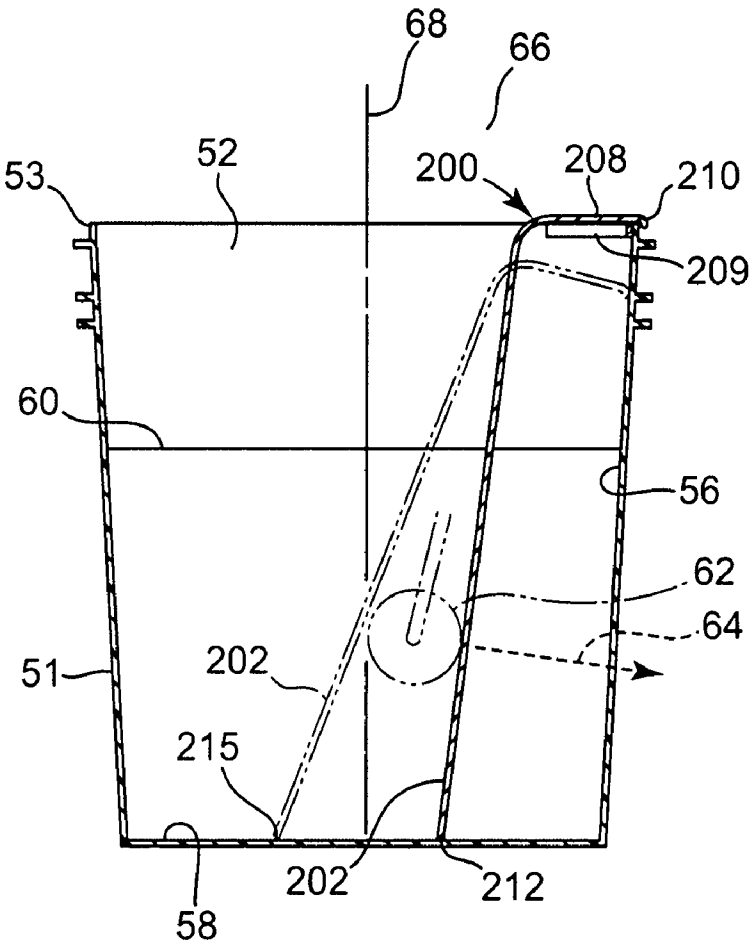
Figure 2B:
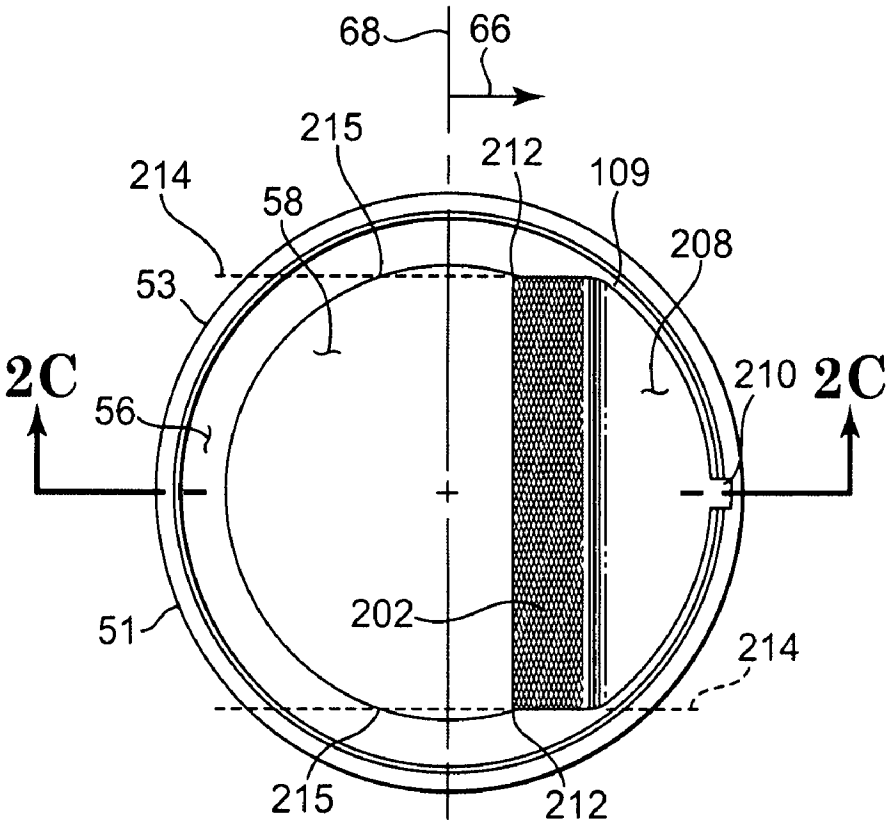

FIGS. 2A-2C illustrate a removable roller surface insert 200 in accordance with another embodiment of the invention. Like the insert 100, the insert 200 may include a substantially planar roller surface 202 that may be positioned in the container 51 in a use position as shown in FIGS. 2A-2C (solid lines in FIG. 2C). The roller surface 202 may extend upwardly from the floor 58 of the container 51 at an angle similar to that described above with reference to the embodiment of FIGS. 1A-1C. The particular construction of the roller surface 202 may be similar to that already described above with respect to the surface 102.

The insert 200 may include a first or lower contact portion defined, in one embodiment, by a bottom edge of the roller surface 202 itself. The bottom edge is preferably operable to seat along the floor 58 and against the sidewall surface 56 as illustrated in the figures. Optionally, the insert 200 could include a foot similar to the foot 104 described above.

While shown herein as resting directly along the floor 58 of the container, the roller surface 202 could, in other embodiments, terminate above the floor. In such embodiments, the roller insert 200 could optionally include extensions or legs (not shown) that extend downwardly beyond the lower edge of the roller surface 202 to contact the floor 58. It may be preferable, however, to limit the maximum distance between the floor 58 and the lower edge of the roller surface 202 to something less than the diameter of the applicator 62 (e.g., to a distance about equal to radius of the applicator). Such a configuration may ensure that the applicator 62 can easily contact the roller surface 202 even when the applicator is contacting the floor.

The insert 200 may further include a second or upper container contact portion, e.g., cap 208, attached at or near an upper edge of the roller surface 202. The cap 208 may, unlike the cap 108, include a hook 210 operable to engage the upper rim 53 of the container 51 as illustrated. As a result, when the insert 200 is in the use position (solid line rendering in FIG. 2C), the hook extends above and engages the rim 53 of the container 51 as shown in FIG. 2B. The semicircular cap 208 may include contact surfaces (e.g., tabs (not shown) or a downwardly extending lip 209 (FIG. 2C)), to contact and rest against the inner sidewall surface 56, e.g., at or near the upper rim 53, when the insert 200 is in the use position. In the illustrated embodiment, the lip 209 may be shaped to generally conform to the shape of the inner sidewall surface 56. As with the insert 100, the cap 208 may attach to the surface 202 with a flexible or pivotable connection, e.g., a living hinge.

The shape of the cap 208 and hook 210, as well as the length of the roller surface 202, may be configured to locate the roller surface in the desired position. Moreover, the cap 208 could include other features not illustrated herein, e.g., a slot or other opening similar to the slot 110 of FIGS. 1A-1C. Once again, the insert 200 (e.g., the roller surface 202, the cap 208, and the hook 210) may be formed (e.g., molded) as a single component.

As with the cap 108, the cap 208 is bound by a plane that contains the roller surface 202, and spans between the upper edge of the roller surface and the inner sidewall surface 56 of the container at or near the upper rim 53 as illustrated.

To permit attachment of the lid 54 (see FIG. 1A) with the container 51, the insert 200 may be movable from the use position shown in FIGS. 2A-2C (solid lines in FIG. 2C) to a storage position. That is, the hook 210 may be de-coupled from the rim 53 of the container 51 and the insert 200 moved to the storage position shown in broken lines in FIG. 2C. When the insert 200 is placed in the storage position, it is contained within the volume of the container 51, e.g., it is below the rim 53. As a result, the lid 54 may be attached and secured to the container 51 while the insert 200 is contained therein.

In use, the insert 200 may operate substantially like the insert 100 described above. For example, it may be placed into the container 51 (after removal of the lid 54). Once seated in the use position as shown in the figures, the applicator 62 (FIG. 2C) may be dipped into the paint 60, withdrawn, and rolled back and forth over a portion of the roller surface 202 that is not submerged (similar to the action of the applicator 62 illustrated in FIG. 1C).

The insert 200 (e.g., the roller surface 202) may have a width such that, when the insert is placed in the use position, the lower edge of the roller surface seats against the sidewall surface 56 at first locations 212 along the perimeter of the floor 58 (see FIG. 2B). That is, the lower edge of the surface 202 may engage the sidewall surface 56 with interference at the first locations 212. As a result, pushing forces 64 applied by the applicator 62 to the surface 202 (see FIG. 2C) may be reacted by the sidewall surface 56 at the first locations 212 (as well as via the cap 208).

Preferably, the cap 208 may be configured to support the insert 200 relative to an upper surface of the first half 66 of the container 51 (see FIG. 2C). The insert 100 may also be configured such that all, or substantially all, of the insert, e.g., roller surface 202 and cap 208, is when in the use position, located on the first side of the vertical plane 68 (see FIGS. 2B and 2C) of the container 51, e.g., within the first half 66. As a result, generally unimpeded applicator access is permitted, via the open top 52, to a larger volume of the paint 60 than would be permitted if the insert 200 spanned across the vertical plane 68. Moreover, by keeping the insert 200 to one side of the plane 68, the applicator 62 may operate in the widest portion of the container when near the floor 58, i.e., near the center as shown in FIG. 2C.

At the completion of the painting project, the insert 200 may be moved to the storage position and the lid 54 (see FIG. 1A) may be attached to the container. To move the insert 200 to the storage position, it may first be lifted to disengage the hook 210 from the rim 53. The lower edge of the insert 200 may then be moved from the positions 212, along secant lines 214 (which form chords across the floor 58), to second positions 215. Once again, the insert 200 may be generally retained in the storage position by engagement of the lower edge of the insert 200 with the container 51 at the second locations 215, and by contact of the cap 208, e.g., hook 210, with the sidewall surface 56 as shown in broken lines in FIG. 2C.

Figure 3A:
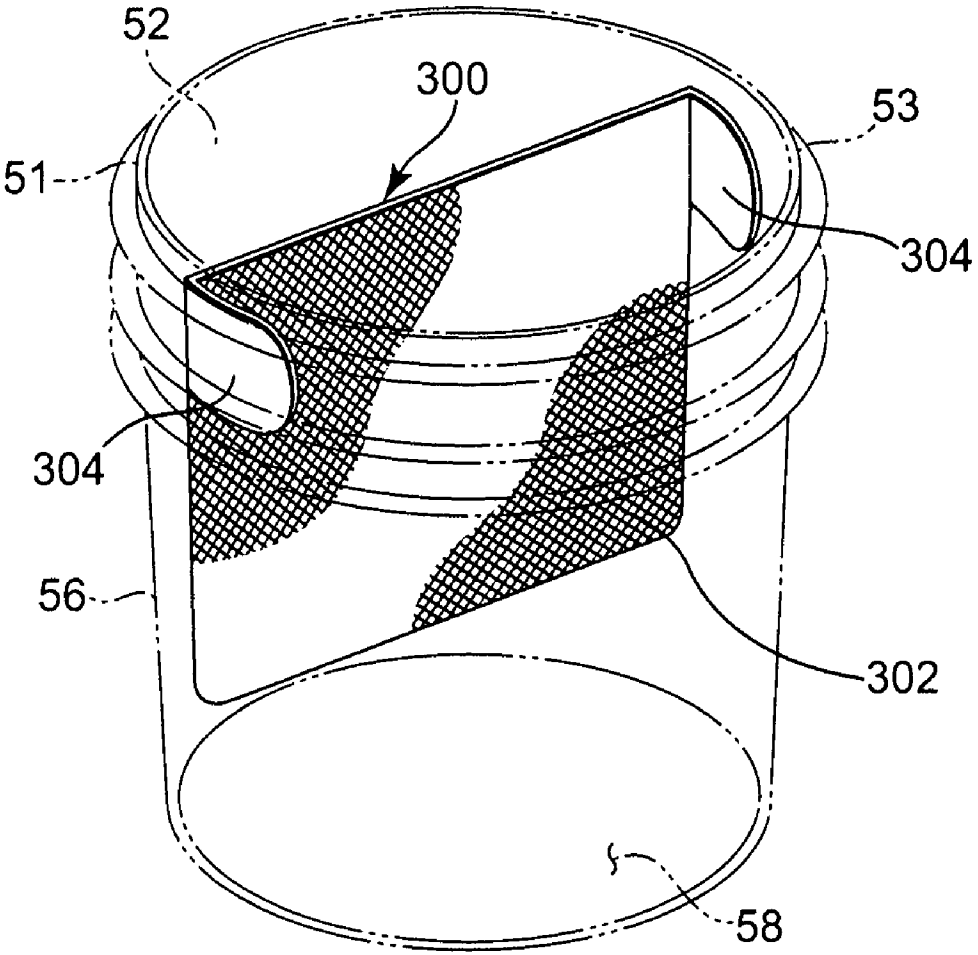
Figure 3C:
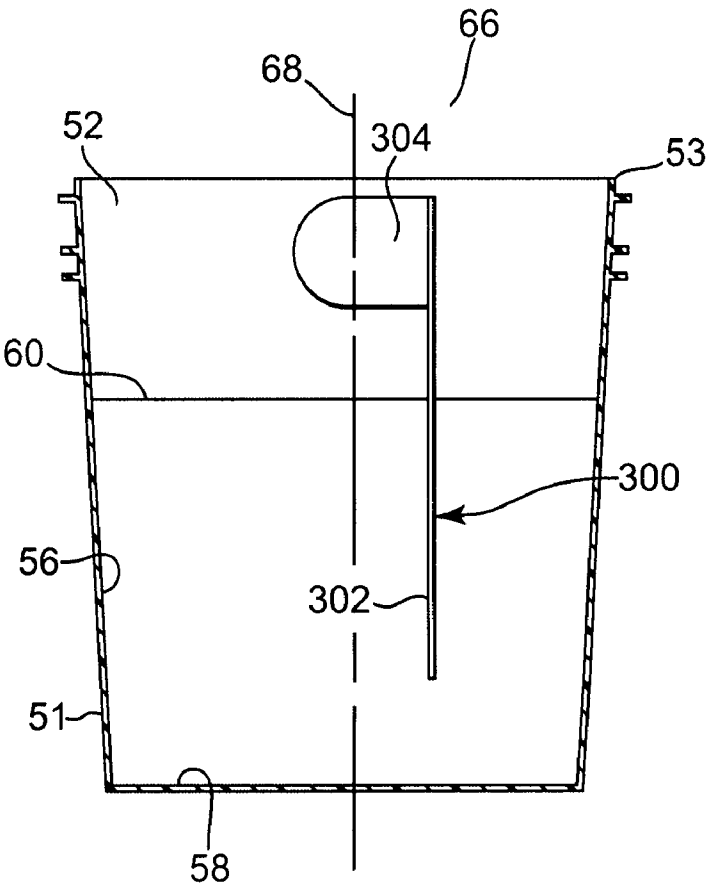
Figure 3B:
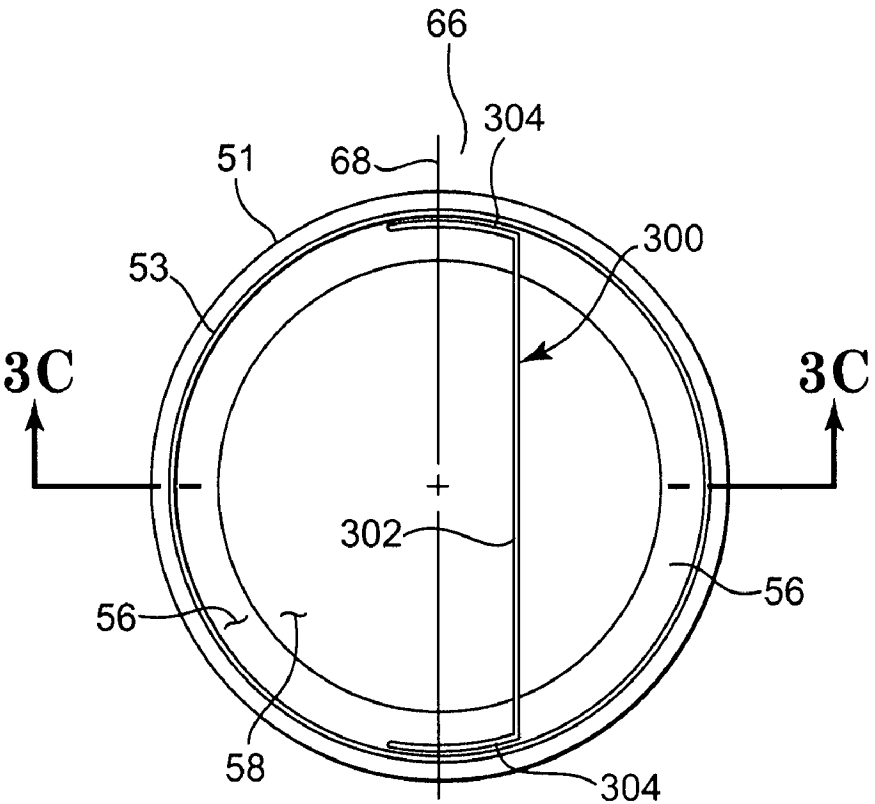

FIGS. 3A-3C illustrate an insert 300 in accordance with yet another embodiment of the present invention. The insert 300, like the inserts 100 and 200 described above, may include a substantially planar roller surface 302. When the insert 300 is positioned in the container 51 in a use position, the roller surface 302 may extend upwardly at an angle similar to that described above with reference to FIGS. 1A-1C, e.g., generally vertically (see FIGS. 3B and 3C). The roller surface 302 may be configured in manner similar to the roller surface 102 already described herein (e.g., a perforated surface). Preferably, the roller surface 302 is located to one side 66 of the vertical plane 68 when in its use position as represented in FIGS. 3B and 3C.

The insert 300 may include contact portions, e.g., two opposing ears 304. The ears 304 are preferably flexible such that they may deflect as the insert 300 is pushed into the container 51. The tapered sidewall surface 56 of the container 51 permits the ears 304 to fit within the open top 52 but eventually engage the sidewall with interference when the insert reaches the desired depth within the container. The outward force of the ears 304 may result in the ears seating substantially across the diameter of the container 51. Preferably the ears 304 are shaped (e.g., arced) to seat evenly against the sidewall surface 56. In other embodiments, the frictional engagement of the ears with the container 51 could be augmented (or supplanted) by features, e.g., tabs or slots, on the container that permit the ears 304 to mechanically couple, e.g., snap, in place. The roller surface 302 and the ears 304 may be formed (e.g., molded) as a single component. In an alternate embodiment, the ears 304 may be replaced with a ring similar to the ring 404 described below.

Although not illustrated, the insert 300 could include a slot or other opening (e.g., in a top portion of the surface 302) to allow for grasping of the insert with a hand or tool for removal and insertion into the container 51.

The insert 300 may be configured such that, when positioned in the container 51 in its use position as illustrated, an uppermost portion of the insert, e.g., each ear 304, is below the top edge or upper rim 53 of the container (see FIGS. 3A and 3C). As a result, the insert may remain in the container when the lid 54 (see FIG. 1A) is secured thereto. A lower edge of the roller surface 302 may be suspended above the floor of the container as shown in FIG. 3C.

In use, the insert 300 may operate substantially like the insert 100 described above. For example, it may be placed into the container 51 (after removal of the lid 54). Once seated in the use position shown in the figures, the applicator (not shown) may be dipped into the paint 60, withdrawn, and rolled back and forth over a portion of the roller surface 302 that is not submerged (similar to the action of the applicator 62 illustrated in FIG. 1C). One advantage of the insert 300 (and other inserts herein that do not extend to the container floor) is that the paint roller may be rolled across the portion of the floor 58 extending underneath the roller surface 302. This may permit access to any paint remaining in the container without requiring container tipping. At the completion of the painting project, the lid 54 (see FIG. 1A) may be attached without removing or repositioning the insert 300.

Figure 4A:
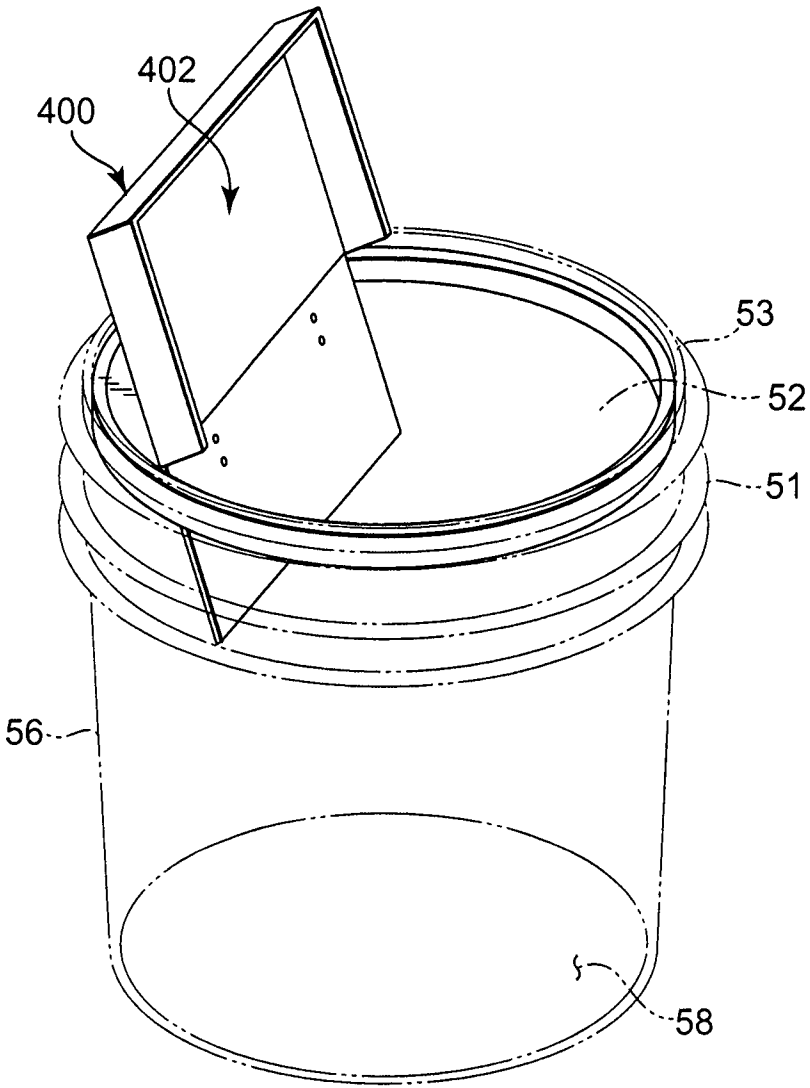

FIGS. 4A-4D illustrate an insert 400 in accordance with yet another embodiment of the present invention. The insert 400, like the inserts 100, 200, and 300 described above, may include a roller surface 402 as shown in FIG. 4A. When the insert 400 is positioned relative to the container 51 in a use position, the roller surface 402 may extend upwardly at an angle similar to that described above with reference to FIGS. 1A-1C.

The roller surface insert 400 may include a contact portion, e.g., friction ring 404. The tapered sidewall 56 of the container 51 permits the ring 404 to fit within the open top 52 but eventually frictionally engage the sidewall with interference when the insert reaches the desired depth in the container. Preferably, a peripheral shape of the ring 404 generally conforms to a shape of a corresponding portion of the sidewall 56 to provide generally uniform loading. In the illustrated embodiment, the ring 404 may, in its desired location, be positioned below the rim 53. Similarly, as with the previous embodiments, the insert 400 may be configured to locate the roller surface 402 on a first half 66 of the container as shown in FIG. 4C.

The ring 404 may include a brace 406 (see exploded view of FIG. 4D) extending across a portion of the ring to provide the ring with the desired structural integrity. The brace 406 may include a stiffener, e.g., a shelf 407 as illustrated in FIG. 4D, to further increase the strength of the ring 404.

Figure 4D:
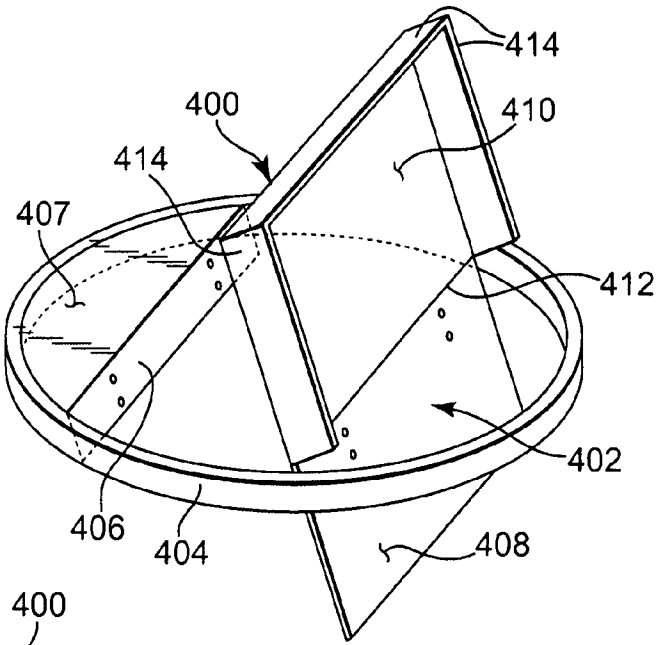
Figure 4B:
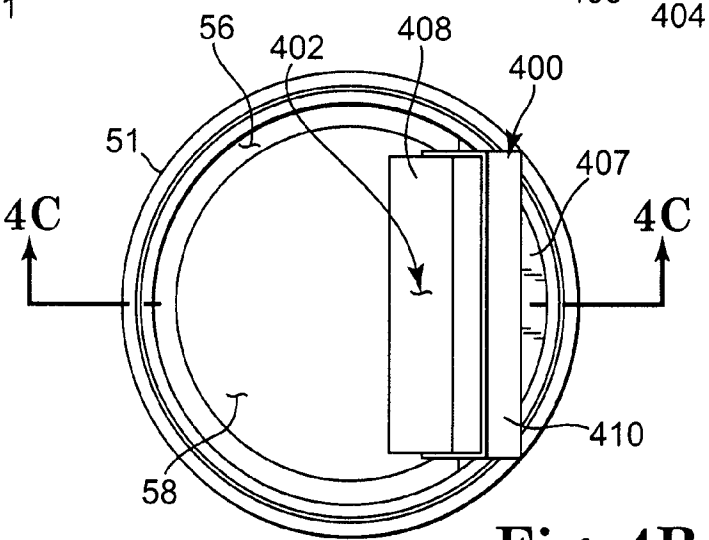
Figure 4C:
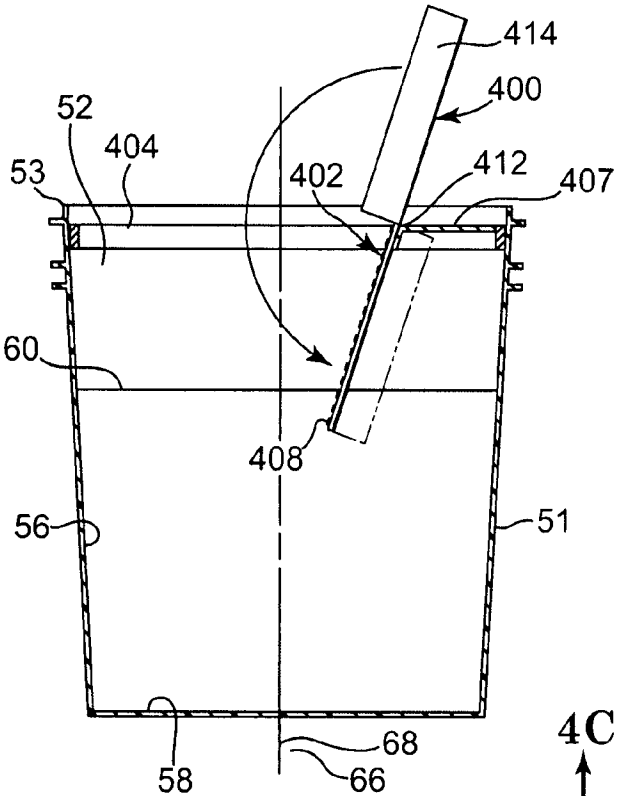

In the illustrated embodiment, the insert 400 may be configured as two separate pieces: the ring 404; and the roller surface 402 (these parts are shown exploded and removed from the container 51 for clarity in FIG. 4D). The roller surface 402 may attach to the brace 406 (e.g., via fasteners, ultrasonic welding, adhesives, etc.). In the illustrated embodiments, the brace 406 may be angled to locate the roller surface 402 as desired.

The roller surface 402 may, in one embodiment, include a lower roller surface portion 408 coupled to an optional upper roller surface portion 410 by a hinge, e.g., living hinge 412. The lower roller surface portion 408 may be attached to the brace 406 and remain relatively fixed relative thereto. The upper roller surface portion 410, however, may pivot about the living hinge 412 between a use position (solid line rendering in FIG. 4C)—where it may, for example, rest against the rim 53—and a stored position (see broken line rendering in FIG. 4C). As illustrated in FIG. 4C, when the roller surface 402, e.g., the upper roller surface portion 410, is placed in the stored position, the insert 400 is below the rim 53, e.g., it is completely contained within the volume of the container 51. As a result, the lid 54 (see FIG. 1A) may be attached to the container while the insert 400 is contained therein.

Although not illustrated in detail herein, the roller surface 402, e.g., the lower roller surface portion 408 and the upper roller surface portion 410, may be configured similarly to the roller surface 102 already described herein. For example, at least the lower roller surface portion 408 may be a perforated surface such as a grid or screen. Alternatively, it could be some other discontinuous (e.g., having raised protrusions) or continuous (e.g., generally flat or featureless) surface. Moreover, to prevent spillage of paint, the upper roller surface portion 410 may include a raised perimeter 414 (see FIG. 4D). The raised perimeter 414 may assist in containing paint and guiding it back into the container 51.

Although not illustrated, the insert 400 could include a slot or other opening (e.g., located on the shelf 407) to allow for grasping of the insert with a hand or tool during insertion and removal from the container.

In use, the insert 400 (which may be provided with the container or purchased separately) may be placed into the container 51 after removal of the lid 54. The ring 404 may be pushed into the container until it seats firmly below the upper rim 53. Once seated as shown in the figures, the roller surface 402, e.g., the upper roller surface portion 410, may be placed in the use position, after which the applicator may be dipped into the paint 60, withdrawn, and rolled back and forth over a portion of the roller surface 402 that is not submerged. Advantageously, the optional upper roller surface portion 410 provides substantial exposed roller surface regardless of the level of paint 60. If any paint is remaining in the container 51 at the completion of the painting project, the roller surface 402, e.g., upper roller surface portion 410, may be moved to the stored position (see FIG. 4C), by pivoting the upper roller surface 410 about the hinge 412, after which the lid 54 may be attached and sealed to the container 51.

Figure 5C:
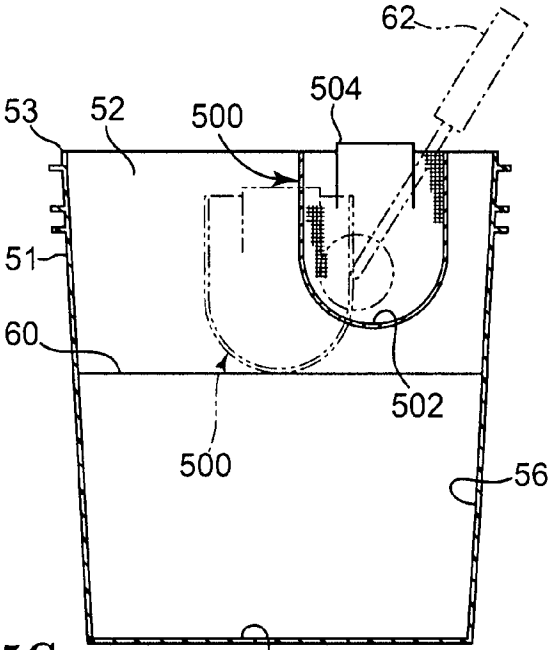
Figure 5B:
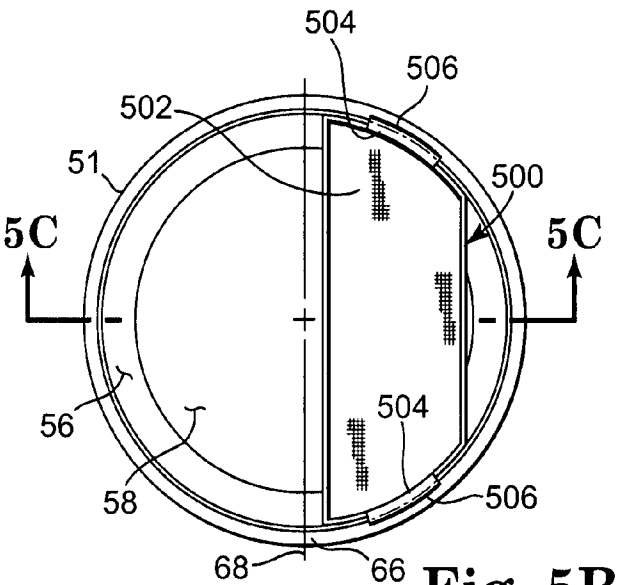
Figure 5A:
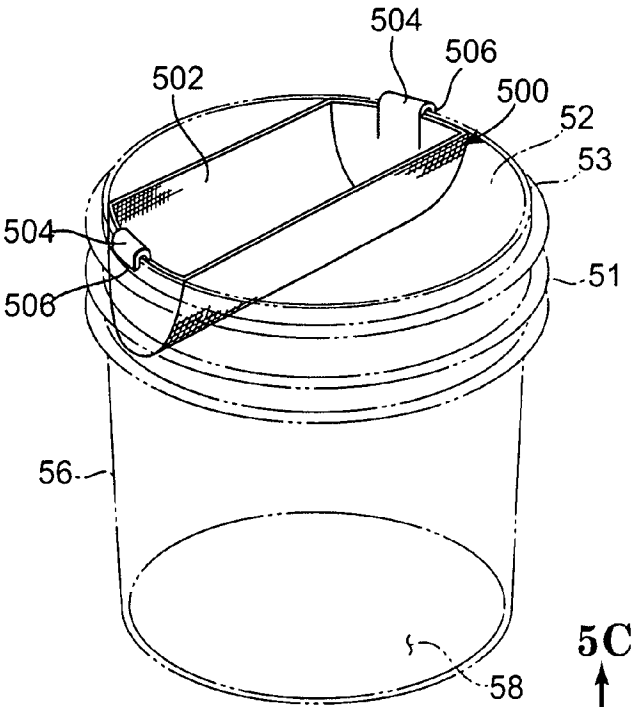

FIGS. 5A-5C illustrate an insert 500 in accordance with yet another embodiment of the present invention. The insert 500, like the other inserts described above, may include a roller surface 502. However, unlike the previous embodiments, the roller surface 502 is not planar but, rather, curved (e.g., it may be generally semi-cylindrical in shape) as shown in FIG. 5A. Nonetheless, the roller surface 502 may be configured in manner similar to the roller surface 102 already described herein. For example, the roller surface 502 is preferably perforated (or includes other openings) to prevent trapping of paint within the insert 500. The linear length of the roller surface 502 (the length if it were laid flat) is preferably equal to or greater than a circumference of a standard paint roller 62 (see FIG. 5C). The ends of the surface may be open or, alternatively, may include endcaps as shown to provide the roller surface 502 with increased structural integrity.

The insert 500 may include contact portions, e.g., ears 504. The ears 504 may include hooks 506 that permit hanging of the insert from the rim 53 of the container 51 when the insert is in a use position as shown in solid lines in FIGS. 5A-5C. Preferably, the hooks 506 are flexible such that, when the insert 500 is unhooked from the rim 53, the hooks 506 may be squeezed inwardly. With the hooks pushed inwardly, the insert 500 may then be inserted into the container 51 with the hooks 506 located on the inside of the container. In this configuration, the insert may be inserted to an elevation below the rim 53, e.g., to a stored position as shown in broken lines in FIG. 5C.

While illustrated as being in a generally more central location in the stored position than the use position, the storage position of the insert 500 could also be generally vertically offset from the use position without departing from the scope of the invention.

In use, the insert 500 may be placed into the container 51 after removal of the lid 54. The hooks 506 may be placed over the rim 53 so that the insert is supported over the paint 60 as shown in FIGS. 5B and 5C. Once seated in the use position (solid line rendering in FIGS. 5A-5C), the applicator 62 may be dipped into the paint 60, withdrawn, and rolled back and forth over the roller surface 502 (see FIG. 5C). The insert 500 is beneficial in that it may be located above the paint even when the container is substantially full. Moreover, the insert 500 may serve as a cradle to hold the paint roller when not in use as indicated in FIG. 5C. At the completion of the painting project, the insert 500 may be lifted upwardly to disengage the hooks 506 from the rim 53. The insert 500 may then be located more towards the center of the container 51, and/or the hooks 506 may be squeezed or pressed inwardly, until the hooks fit within the container. The insert 500 may then be pushed into the container until it reaches the storage position (broken line rendering in FIG. 5C), after which the lid 54 (see FIG. 1A) may be re-attached.

Figure 6B:
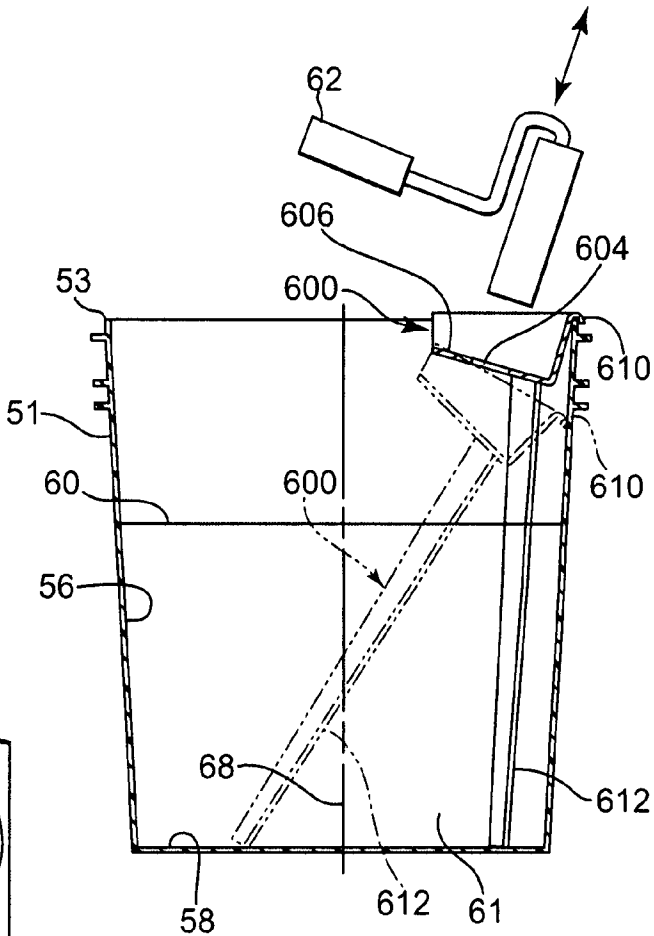
Figure 6C:
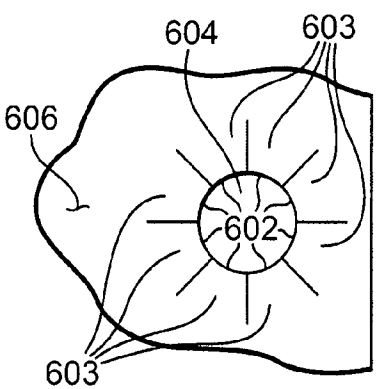
Figure 6A:
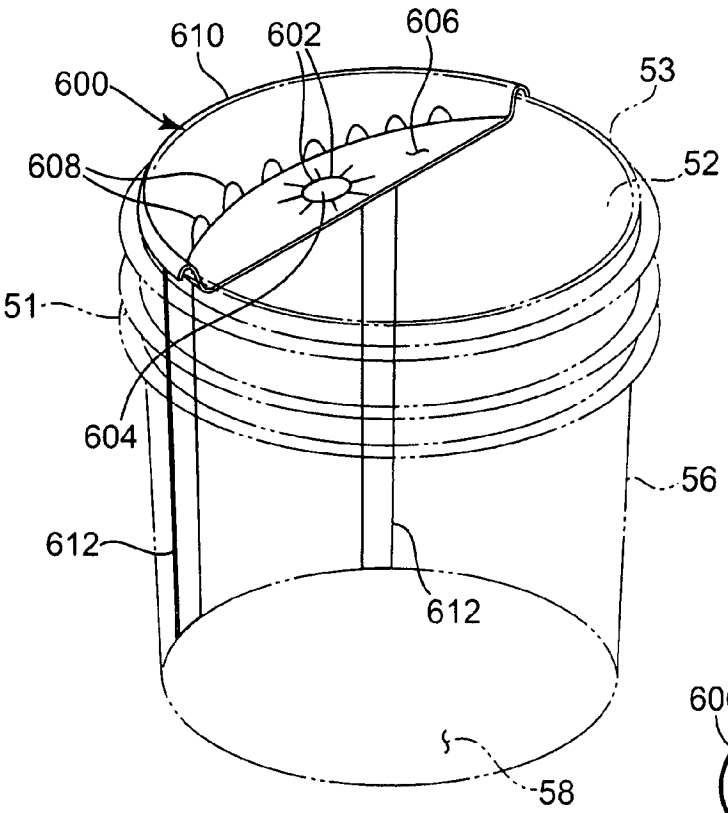

FIGS. 6A-6C illustrate an insert 600 in accordance with still yet another embodiment of the present invention. The insert 600, like the other inserts described above, may include a roller surface. However, unlike the planar roller surfaces 102 and 202, or the semi-cylindrical roller surface 502, the roller surface of the insert 600 is formed by a plurality of roller surfaces 602 surrounding an opening 604 as shown in FIG. 6A. The opening 604 may be formed on an upper surface 606 of the insert 600. The upper surface 606 may be sloped to direct excess paint 60 back into the container 51 via one or more openings 608.

The upper surface 606 may include a contact portion, e.g., a lip 610, operable to conform to the rim 53 of the container 51. The lip 610 may surround a portion of the open top 52 as shown in FIG. 6A. In some embodiments, the lip mechanically engages the container sufficiently to resist separation when the paint roller 62 is withdrawn from the opening 604 as further described below. The insert 600 may further include one or more, e.g., two, standoffs 612 to assist in supporting the upper surface 606 relative to the container floor 58 and/or sidewall surface 56. Although not illustrated, the insert 600 could include a slot or other opening to allow for grasping of the insert with a hand or tool during insertion/removal into the container.

Due to its coupling with the rim 53, the insert 600 may interfere with the lid 54 (see FIG. 1A) when in the use position. As a result, the insert 600 may be moved to a storage position as shown in broken lines in FIG. 6B (FIG. 6B is a section view taken along a vertical plane containing both the centerline of the container 51 and the centerline of the opening 604). When in this storage position, the insert 600 is separated from the container 51 and is relocated to an elevation below the rim 53. Accordingly, the lid 54 may be attached while the insert is within the container 51.

The roller surfaces 602 surround the opening 604. The surfaces 602 are cantilevered to the upper surface 606 at their respective outermost edges. The surfaces 602 may move independently of one another and produce a squeegee action when the applicator 62 (see FIG. 6B) passes through the opening 604. In the illustrated embodiment, the surfaces 602 are formed by inner edges of a plurality of flexible partial pie-shaped elements 603 as shown in the partial plan view of the upper surface 606 represented in FIG. 6C. The effective diameter of the opening 604 may be smaller than, or equal to, an effective diameter of the applicator 62. As with the previous embodiments, the insert 600, e.g., the roller surfaces 602, may be located, at least in the use position, on the first side or half 66 of the container 51, e.g., to one side of the vertical plane 68 as shown in FIG. 6B.

In use, the insert 600 (which may be provided with the container or purchased separately) may be placed into the container 51 (after removal of the lid 54). Once seated in the use position shown in the figures (e.g., seated such that the lip 610 is secured to the rim 53), the applicator 62 may be dipped into the paint 60, withdrawn, pushed downwardly through the opening 604, and then withdrawn upwardly as represented by the arrows in FIG. 6B. This motion along the roller surfaces 602 assists in both distributing paint over the applicator surface and in removing excess paint therefrom. In some embodiments, the user may push against the insert 600 as the applicator 62 is withdrawn. Excess paint may flow directly back into the container 51 from the lower side, or down the upper surface 606 from the upper side where it may re-enter the container through the openings 608. The insert 600 is beneficial in that it may be located above the paint even when the container is substantially full. At the completion of the painting project, the insert 600 may be lifted off the rim 53 and moved to the storage position (see FIG. 6B), where the lid 54 (see FIG. 1A) may then be attached.

Paint roller inserts and containers in accordance with the present invention provide several advantages over conventional liquid containers and their associated roller trays. For example, no separate roller tray is required. Thus, setup and cleanup time may be reduced. Moreover, the inserts described herein are operable to work with standard paint containers that hold a relatively large quantity of liquid, reducing or eliminating the need to frequently replenish the liquid supply as is common with conventional roller trays. Inserts as described herein may also be reusable and storable within the paint container.

The complete disclosure of the patents, patent documents, and publications cited in the Background, the Detailed Description of Exemplary Embodiments, and elsewhere herein are incorporated by reference in their entirety as if each were individually incorporated. In the event that any inconsistency exists between the disclosure of the instant application and the disclosure(s) of any document incorporated herein by reference, the disclosure of the instant application shall govern.

Illustrative embodiments of this invention are discussed and reference has been made to possible variations within the scope of this invention. These and other variations, modifications, and combinations of the invention will be apparent to those skilled in the art without departing from the scope of the invention, and it should be understood that this invention is not limited to the illustrative embodiments set forth herein. Rather, the invention is to be limited only by the claims provided below, and equivalents thereof.

What is claimed is:

1. A removable roller surface insert for use within a generally cylindrical, open-top container having an upper rim and a floor, the container including a first half and a second half defined by a vertical plane passing through a centerline of the container, wherein the insert comprises:

a substantially planar roller surface operable to distribute a rollable liquid residing within the container over a roller applicator, the roller surface comprising an upper edge and a lower edge;

a substantially planar upper contact portion attached to and extending from the upper edge of the roller surface, the upper contact portion comprising a peripheral edge having an arc shape that generally conforms to a shape of a corresponding portion of an inner sidewall surface of the container, the upper contact portion configured to span between the upper edge of the roller surface and the inner sidewall surface at a location at or near the upper rim; and a substantially planar lower contact portion attached to and extending from the lower edge of the roller surface such that it spans across the lower edge, the lower contact portion comprising opposite outer peripheral edges each having an arc shape that generally conforms to a shape of the floor and an adjoining portion of the inner sidewall surface of the container, wherein the upper and lower contact portions are generally parallel to one another and further extend in opposite directions from the roller surface;

wherein all of both the roller surface and the upper contact portion are, when the insert is in a use position, located within the first half of the container below the upper rim.

2. The insert of claim 1, wherein the upper contact portion defines an opening.

3. The insert of claim 1, wherein the lower contact portion defines one or more openings.

4. The insert of claim 1, wherein the roller surface is pivotally coupled to the upper contact portion.

5. The insert of claim 1, wherein the roller surface is pivotally coupled to the lower contact portion.

* * * * *